US010729230B2

(12) United States Patent
Prade et al.

(10) Patent No.: US 10,729,230 B2
(45) Date of Patent: Aug. 4, 2020

(54) APPLICATOR FOR APPLYING A COSMETIC PRODUCT

(71) Applicant: L'OREAL, Paris (FR)

(72) Inventors: Pauline Prade, Clichy (FR); Eric Caulier, Clichy (FR)

(73) Assignee: L'OREAL, Paris (FR)

( * ) Notice: Subject to any disclaimer, the term of this patent is extended or adjusted under 35 U.S.C. 154(b) by 188 days.

(21) Appl. No.: 15/571,981

(22) PCT Filed: May 4, 2016

(86) PCT No.: PCT/EP2016/060083
§ 371 (c)(1),
(2) Date: Nov. 6, 2017

(87) PCT Pub. No.: WO2016/177827
PCT Pub. Date: Nov. 10, 2016

(65) Prior Publication Data
US 2018/0140082 A1 May 24, 2018

(30) Foreign Application Priority Data
May 6, 2015 (FR) ..... 15 54056

(51) Int. Cl.
*A46B 9/02* (2006.01)
*A45D 34/04* (2006.01)

(52) U.S. Cl.
CPC ..... *A46B 9/021* (2013.01); *A45D 34/046* (2013.01); *A46B 2200/1053* (2013.01)

(58) Field of Classification Search
CPC ..... A46B 9/021; A46B 2200/1053; A46B 2200/106; A45D 34/046; A45D 34/042
(Continued)

(56) References Cited

U.S. PATENT DOCUMENTS 4,446,880 A * 5/1984 Gueret ..... A45D 40/265 132/218
5,123,431 A * 6/1992 Wilson ..... A45D 40/28 132/320
(Continued)

FOREIGN PATENT DOCUMENTS

CN 101801236 A 8/2010
EP 0875169 A1 11/1998
(Continued)

OTHER PUBLICATIONS

First Chinese Office Action issued by State Intellectual Property Office of People's Republic of China regarding Application No. 201680026386.0.

*Primary Examiner* — Nicholas D Lucchesi
(74) *Attorney, Agent, or Firm* — McNees Wallace & Nurick LLC

(57) ABSTRACT

Applicator (2) for applying a cosmetic product to the eyelashes and/or eyebrows, having an applicator member (8), the applicator member (8) having:

Figure 1:
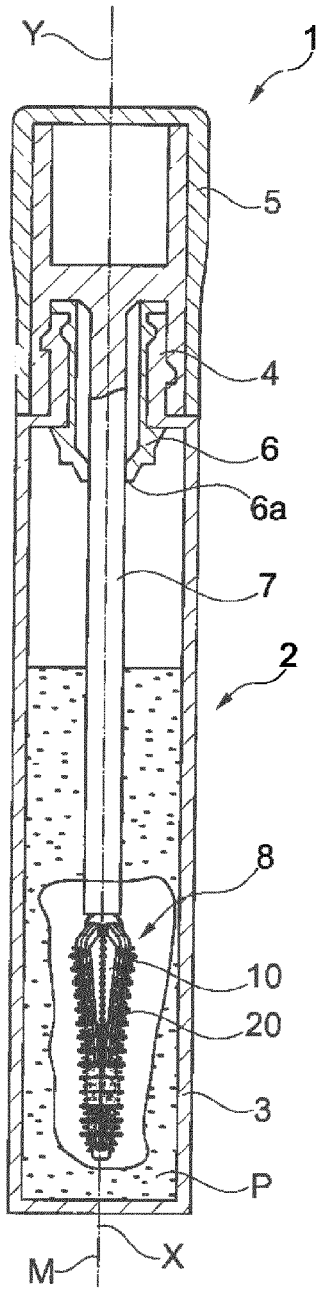

a core (10) that extends along a longitudinal axis (X), and a plurality of different arms (20) that are oriented longitudinally, the arms (20) being connected to the core (10) by their two ends, the length of each arm (20) being greater than the distance (P) along the longitudinal axis of the core (10) between the two ends of the arm (20), the core (10) having at least one portion, between the ends of the arms (20), with a non-circular cross section, and the arms (20) being distributed irregularly around the core (10).

28 Claims, 4 Drawing Sheets

(58) Field of Classification Search
USPC ..... 132/218
See application file for complete search history.

(56) References Cited

U.S. PATENT DOCUMENTS

| | | | | |
|---|---|---|---|---|
| 5,542,439 | A * | 8/1996 | Gueret | A46B 3/18 132/218 |
| 5,894,847 | A * | 4/1999 | Gueret | A46B 3/18 132/218 |
| 6,067,997 | A * | 5/2000 | Gueret | A45D 40/267 132/218 |
| D637,004 | S | 5/2011 | Manici | |
| 7,980,253 | B2 * | 7/2011 | Dumler | A45D 40/26 132/218 |
| D674,196 | S | 1/2013 | Jacob et al. | |
| D682,556 | S | 5/2013 | Uresti et al. | |
| 2002/0014250 | A1 * | 2/2002 | Gueret | A45D 40/267 132/218 |
| 2002/0020426 | A1 * | 2/2002 | Gueret | A45D 33/02 132/218 |
| 2005/0217691 | A1 * | 10/2005 | Petit | A45D 40/265 132/320 |
| 2005/0249539 | A1 * | 11/2005 | Habatjou | A45D 40/265 401/127 |
| 2006/0279181 | A1 * | 12/2006 | Gueret | A45D 40/262 312/218 |
| 2008/0023020 | A1 * | 1/2008 | Gueret | A45D 40/265 132/218 |
| 2009/0065020 | A1 * | 3/2009 | Butcher | A45D 40/265 132/218 |
| 2010/0192968 | A1 * | 8/2010 | Gueret | A45D 40/265 132/200 |
| 2010/0200013 | A1 * | 8/2010 | Kim | A45D 40/265 132/218 |

FOREIGN PATENT DOCUMENTS

| | | | |
|---|---|---|---|
| FR | 2961384 | A1 | 12/2011 |
| FR | 2993151 | A1 | 1/2014 |
| FR | 3004905 | A1 | 10/2014 |
| FR | 3006566 | A1 | 12/2014 |
| WO | 2011158173 | A1 | 12/2011 |
| WO | 2011161584 | A1 | 12/2011 |
| WO | 2012085398 | A2 | 6/2012 |

* cited by examiner

APPLICATOR FOR APPLYING A COSMETIC PRODUCT

The present invention relates to applicators for applying a cosmetic product to the eyelashes or eyebrows, notably a makeup or care product, for example mascara, and to corresponding packaging and application devices.

The invention also relates to devices having a container which contains the product to be applied and is preferably provided with a wiping member.

These packaging and application devices have, in a manner known per se, a stem and an applicator at the end of the latter. The stem can extend along a rectilinear or non-rectilinear longitudinal axis. The applicator may have a core that extends along a rectilinear or non-rectilinear longitudinal axis, and may extend in line with the stem or form an elbow therewith. These configurations provide the user with different holds and possible uses, making it possible to vary the makeup effects.

French Patent Application FR 2993151 discloses an applicator having a core that carries application elements, the core being hollow and having at least one bulging portion having lateral openings.

International Application WO 2011/158173 discloses an applicator having a hollow applicator member, the body of which is formed by arms that carry application elements, and an additional element disposed inside the applicator member, with which the eyelashes can come into contact.

Design Pat. US D682556 discloses an applicator having a core with a circular cross section having two portions from which arms that carry application elements extend. The arms of each portion are distributed evenly around the core.

International Application WO 2012/085398 discloses an applicator having a core that extends along a longitudinal axis and one or more flexible arms that are oriented longitudinally and are embedded at at least two points on the core and have at least one bending zone perpendicular to the longitudinal axis.

There is a need to further improve applicators for applying a product, notably mascara, to the eyelashes and/or eyebrows, in order to improve the performance thereof, and, if need be, allow particular makeup effects to be obtained.

The invention aims to meet this objective and the subject thereof, according to one of its aspects, is an applicator for applying a cosmetic product to the eyelashes and/or eyebrows, having an applicator member, the applicator member having:

- a core that extends along a longitudinal axis, and
- a plurality of different arms that are oriented longitudinally, the arms being connected to the core by their two ends, the length of each arm being greater than the distance P along the longitudinal axis of the core between the two ends of said arm, the core having at least one portion, between the ends of the arms, with a non-circular cross section, and the arms being distributed irregularly around the core.

The fact that the core has a non-circular cross section and the arms are distributed irregularly around the core makes it possible to obtain specific wiping on exiting the container. This makes it possible in particular to off-centre wiping. In particular, it is possible to have, on the applicator member, regions that are less heavily laden with product, at the arms, making it possible to properly separate the eyelashes, and one or more regions that are more heavily laden with product, notably between the arms, making it possible to properly load the eyelashes with product, and giving the applicator autonomy.

The expression "distance P along the longitudinal axis of the core between the two ends of said arm" is understood as meaning the length of the projection of the arm along the longitudinal axis of the core.

The longitudinal axis may be a central axis, or even an axis of symmetry for the core, notably when the core has a circular cross section or a cross section in the overall shape of a regular polygon. The longitudinal axis of the core may be rectilinear or curved and may be contained in a plane, which may be a plane of symmetry for some, or even for all of the cross sections of the core. Preferably, the longitudinal axis of the core is rectilinear.

Preferably, the applicator member is in one piece, notably moulded in a single piece. In a variant, the applicator member is produced by overmoulding from at least two materials. The applicator member may or may not be made of a plastics material, notably thermoplastic or elastomer.

Preferably, the applicator member is symmetrical with respect to a longitudinal median plane.

The applicator member preferably does not have an axis or plane of symmetry orthogonal to the longitudinal axis of the core; it is thus possible for the arms not to have an axis or plane of symmetry orthogonal to the longitudinal axis of the core. As a result, different makeup effects can be obtained depending on which portion of the applicator member is used. The applicator member can thus be produced such that the distal end of the applicator member can reach the eyelashes at the inner corner of the eye, which are more difficult to reach. The arms may be curved in order to follow the curvature of the eyelid and to make it easier to apply the cosmetic product to a large number of eyelashes in one hand movement.

The applicator may have a stem to which the applicator member is fixed, notably having a housing in which an end piece of the applicator member is held. Preferably, the end piece extends along the longitudinal axis of the core.

Core

Preferably, the core is rectilinear. In a variant, the core may have one or more curves.

Also preferably, the core is solid along at least 80% of its length, better still substantially along its entire length.

The core may have at least one cross section with an elongate shape along a major axis, and preferably, the cross section of the core has an elongate shape substantially along the entire length H of the core. The major axis of the cross section of the core may be contained in one and the same plane on moving along the core, notably a median plane of the applicator member. This makes it possible notably to have more vigorous wiping along this median plane.

The ratio $K_2/K_1$ may be between 0.3 and 1, better still between 0.5 and 0.8, $K_1$ being the greatest distance of the surface of the core from the longitudinal axis in the median plane and $K_2$ being the smallest distance from one and the same abscissa on the longitudinal axis in the same plane.

The height, in cross section of the core, may decrease substantially in the direction of the distal end of the core along the majority of the length H. The height of the core may decrease along the longitudinal axis and the cross section may become circular at the distal end of the core.

The expression "height of the core" denotes the dimension of the core along the major axis, in cross section.

The cross section of the core with the greatest height may be closer to the proximal end of the core than to the distal end thereof.

The core may have at least one transverse groove, better still two transverse grooves, extending perpendicularly to the longitudinal axis of the core, notably one or more transverse grooves extending around more than 50%, better still more than 75%, of the circumference of the core. This or these grooves can allow the accumulation of cosmetic product on the applicator member and can constitute reserves of product on application.

Arm-Free Portion

Preferably, the applicator member has, in cross section, an arm-free portion that has an angular extent δ of greater than or equal to 90°, better still greater than or equal to 120°, even better still greater than or equal to 180°, about the longitudinal axis of the core. Preferably, said portion is symmetrical with respect to a median plane of the applicator member.

Arms

The applicator member may have only two arms.

The arms are not aligned longitudinally.

All of the arms may be identical.

Preferably, each of the arms extends in a plane containing the longitudinal axis of the core. Preferably, the arms extend in planes that contain the longitudinal axis of the core and are different in pairs.

Preferably, the arms extend from a top side of the core, the top side being such that it is closer to the longitudinal axis of the core than the opposite side.

The arms may have a substantially constant thickness e of between 0.4 and 2 mm, better still between 0.8 and 1.3 mm.

The arms may have a substantially constant width l of between 0.5 and 4 mm, better still between 1 and 2 mm.

The arms may have a maximum height $h_{max}$, measured from the core, of between 2 and 6 mm, better still between 2.5 and 4 mm. The height $h_{max}$ is greater than or equal to the thickness e of said arm.

The distance P between the two ends of the arms is preferably between 10 mm and 40 mm, better still between 20 mm and 30 mm.

The arms are preferably flexible. This is notably due to the small thickness e of the arms. The arms can thus deform on passing through the wiper.

Preferably, the arms are not in contact with one another. They can be separated at the core by a distance e of greater than or equal to 0.2 mm.

Preferably, the arms are symmetrical with respect to the median plane.

Preferably, the arms form an angle γ of less than or equal to 180°, better still between 45° and 100°, even better still between 50° and 70°, between one another, about the longitudinal axis of the core.

The angular extent of the arms λ is preferably less than or equal to 180°.

The fact that the arms are symmetrical with respect to the median plane and have an angular extent λ of less than or equal to 180° and that the core has an elongate cross section along the median plane makes it possible to have more vigorous wiping, both on the side away from the arms and on the side of the arms. It is thus possible to produce arms having a degree of flexibility while ensuring that they are wiped properly.

Each arm may have at least two portions, namely a proximal portion connected to the core on the proximal side of the applicator member and a distal portion connected to the core on the distal side of the applicator member.

Each arm may have at least two portions that form an elbow with an angle α of preferably between 40° and 145°, better still between 100° and 130°, between one another.

The elbow may be closer to the proximal end of the core than the distal end thereof, and notably be situated at a distance f from the proximal end of the core of between 40% and 5%, better still between 25% and 10%, of the length H of the core.

The distal portion and the proximal portion may be connected together to form an elbow as described above. Thus, each arm may have only the distal and proximal portions.

The proximal portion of an arm may extend, in projection along the longitudinal axis of the core, along a distance g of less than 40%, better still less than 20%, even better still between 20% and 5%, of the distance P along the longitudinal axis of the core between the two ends of the arm.

The portions of the arms may each be generally rectilinear or curved, notably concave or convex towards the longitudinal axis.

One of the portions, notably the proximal portion, may be rectilinear and the other of the portions, notably the distal portion, may be convex towards the longitudinal axis.

The proximal portion may form an angle β of between 10° and 90°, better still between 30° and 70°, even better still between 45° and 60°, with the longitudinal axis.

The distal portion may be connected to the arm at a tangent thereto. The distal portion may be connected to the core along a length d of less than 70%, better still between 50% and 20%, of the distance P.

In a variant, at least one arm may have a convex shape towards the outside along its entire length, and notably have the shape of an arc along its entire length.

In a variant, at least one arm has a plurality of portions that are aligned longitudinally and are each connected to the core by their two ends. The arm portions may be joined, that is to say have a common part, or separate, that is to say not be attached to one another. The portions may each be in the form of an arm as defined above.

Preferably, the arms are not attached to the core along their entire length. The distal portion may have a part that is not in contact with the core. The applicator member may have, between the arms and the core, a space delimited by the proximal portion, the surface of the core and a part of the distal portion. Such a space makes it possible to form a reserve of cosmetic product on the applicator member.

Application Elements

The core may carry at least one longitudinal row of application elements, notably situated between two adjacent arms, and even more preferably at an equal distance from the latter. In a variant, the core may have rows of application elements on either side of at least one arm, better still on either side of all the arms, on moving around the longitudinal axis of the core.

The expression "application element" denotes an individualizable projecting element intended to come into engagement with the human keratin fibres.

The application elements carried by the core can all have substantially the same height k, of between 1 and 10 mm, better still between 3 and 6 mm. The application elements carried by the core are preferably aligned with one another within one row and may all be spaced apart by the same distance o, defined between the centres of gravity of two consecutive application elements, of between 0.1 mm and 5 mm, better still between 0.5 mm and 1 mm.

Preferably, at least one of the arms carries at least one longitudinal row of application elements; two successive arms can each carry at least one row of application elements, and better still all of the arms each carry at least one row of application elements.

The row(s) of application elements on each arm can be carried by the distal portion of said arm only, between the elbow and the distal end of the arm.

Preferably, the application elements carried by one arm are at an equal distance from one another; two consecutive application elements can be spaced apart by a distance u, defined between their centres of gravity, of between 0.1 mm and 5 mm, better still between 0.5 mm and 1 mm.

The application elements carried by the arms can all extend to the same height s from the surface of the arm from which they extend, their height s being between 1 and 3 mm, better still between 1.5 and 2.5 mm.

Preferably, the portion of the core that does not have arms does not have application elements, either.

The application elements may be in the form of spikes or teeth; preferably, the application elements carried by the core are in the form of spikes and the rows of application elements carried by the arms are formed of an alternation, along the longitudinal axis, of teeth and spikes.

The term "teeth" is understood as meaning application elements having at least one flattened cross section. The teeth can be as described in Patent Applications FR 3006566 and FR 3004905.

The teeth may be flattened in a plane transverse to the longitudinal axis of the core.

The teeth may have a largest dimension m, in cross section, greater than the width l of the arm from which they extend.

Preferably, the application elements are moulded with the core and/or with the arms.

A further subject of the invention is a packaging and application device comprising:

a reservoir containing the cosmetic product to be applied, an applicator according to the invention.

The container preferably has a wiping member comprising a wiping lip suitable for wiping the applicator.

The product is preferably a mascara.

A further subject of the invention is a makeup method comprising the step of applying a cosmetic product, notably mascara, with the aid of an applicator according to the invention.

Figure 2:
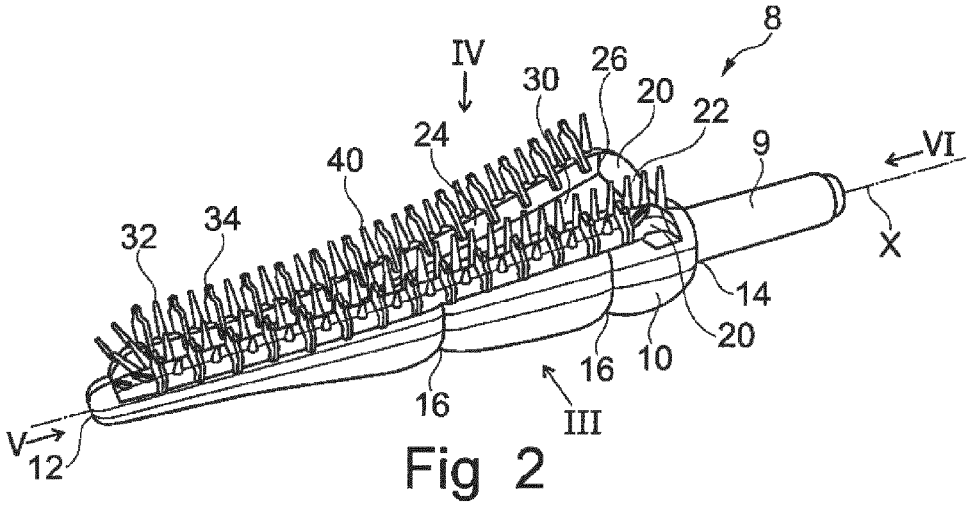
Figure 3:
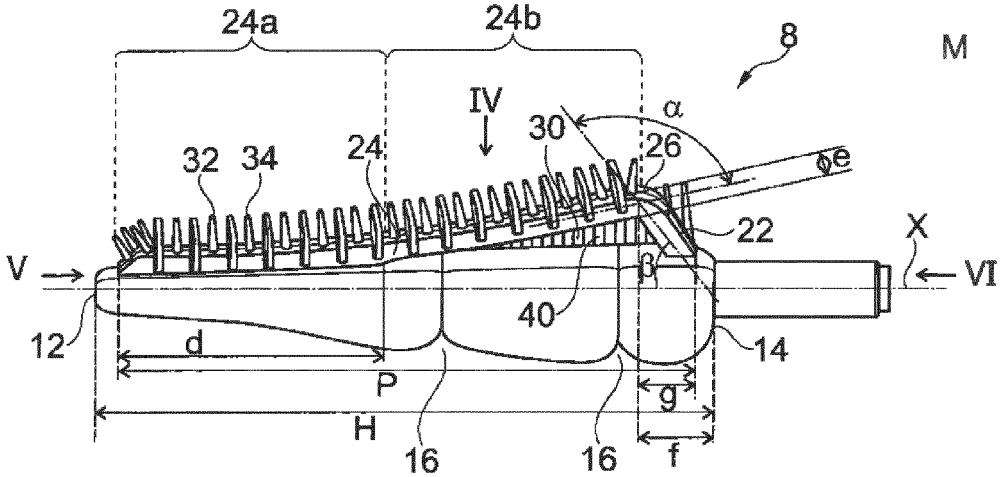
Figure 4:
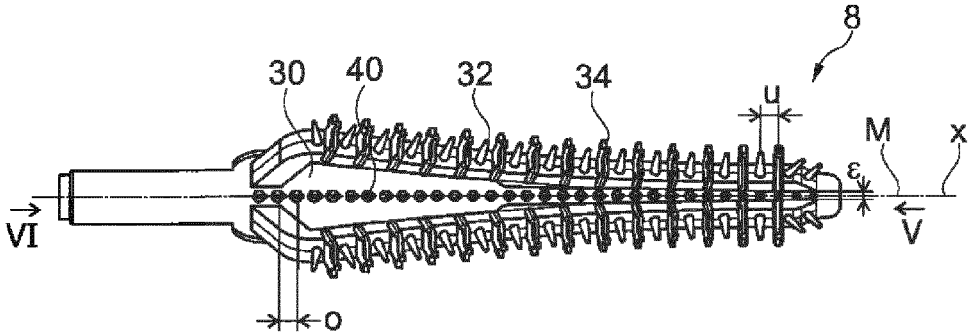
Figure 5:
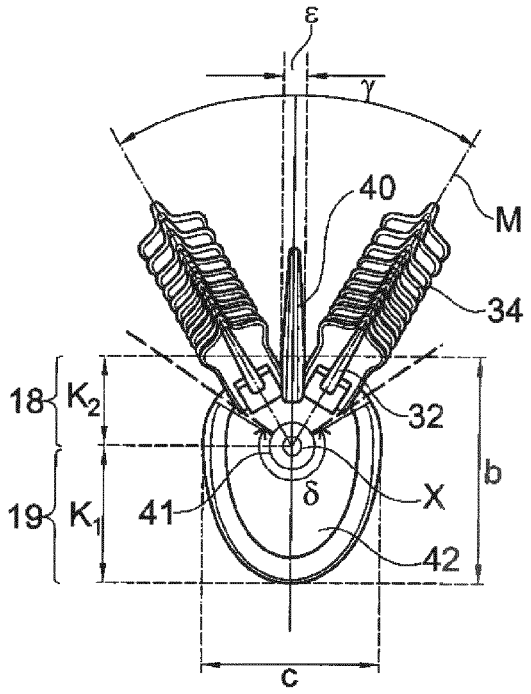
Figure 6:
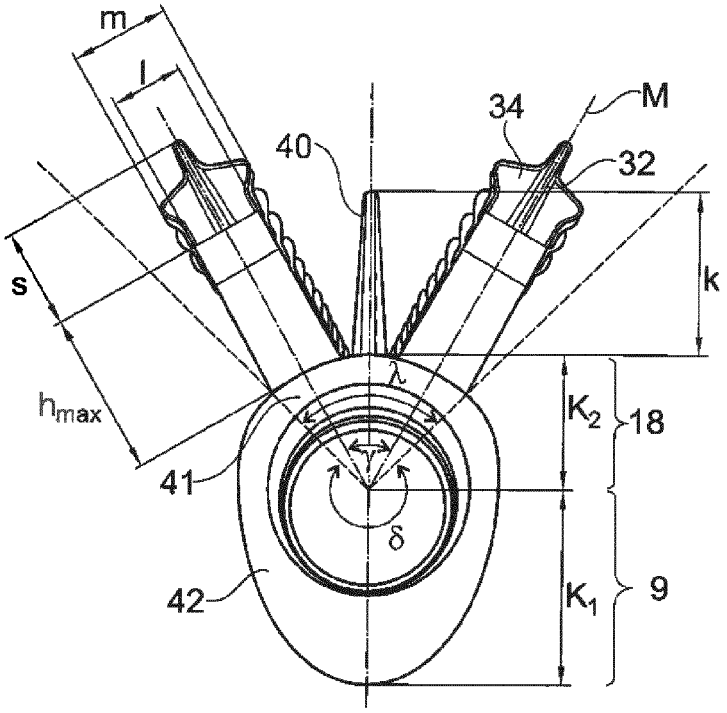

The invention may be better understood from reading the following detailed description of a non-limiting implementation example thereof, and with reference to the attached drawing, in which:

FIG. 1 shows an example of a packaging and application device according to the invention, FIG. 2 schematically shows a perspective view of an example of an applicator member according to the invention, FIG. 3 is a view along III of the applicator member in FIG. 2, FIG. 4 is a view along IV of the applicator member in FIGS. 2 and 3, FIG. 5 is a view along V of the applicator member in FIGS. 2 to 4, FIG. 6 is a view along VI of the applicator member in FIGS. 2 to 5, and FIGS. 7 to 9 schematically show a longitudinal section, on the plane M of FIGS. 5 and 6, of variant applicator members.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also constituting a gripping member for the applicator 2.

The latter has a stem 7, which is attached at its proximal end 12 to the closure cap 5 and, at its distal end 11, to an applicator member 8, having a core 10 that extends along a rectilinear longitudinal axis X.

The container 3 also has a wiping member 6, inserted into the neck 4.

This wiping member 6, which may be of any suitable type, has, in the example in question, a lip designed to wipe the stem 7 and the applicator member 8 when the applicator 2 is withdrawn from the container 3. The lip defines a wiping orifice **6*a* having a diameter adapted to that of the stem 7. The wiping member 6 may be made of elastomer. The wiping orifice 6*a*** has, for example, a circular shape.

The diameter of the wiping orifice **6*a*** is typically between 3 and 5.5 mm, and is for example around 4.5 mm or 5 mm.

In the example illustrated, the stem 7 has a circular cross section, but if the stem 7 has some other section, this does not depart from the scope of the present invention, it then being possible to fix the cap 5 on the container 3 in some other way than by screwing, if necessary. The wiping member 6 is adapted to the shape of the stem 7 and to that of the applicator member 8, if appropriate.

Preferably, and as in the example in question, the longitudinal axis Y of the stem 7 is rectilinear and coincident with the longitudinal axis of the container 3 when the applicator member 8 is in place thereon, but if the stem 7 is not rectilinear, forming for example an elbow, this does not depart from the scope of the present invention.

If need be, the stem 7 may have an annular narrowing at its portion that is positioned opposite the lip of the wiping member 6, so as not to mechanically stress the latter unduly during storage.

As illustrated in FIG. 2, the applicator member 8 may have an end piece 9 for fixing it in a corresponding housing of the stem 7.

The applicator member 8 may be fixed in this housing of the stem 7 by any means, and notably by force-fitting, snap-fastening, adhesive bonding, welding, stapling or crimping.

The core 10 of the applicator member 8 carries arms 20, notably two arms, as illustrated. These arms are identical and each extend in a plane M, illustrated in FIGS. 5 and 6, containing the longitudinal axis X of the core 10. The arms 20 are not in contact with one another. They are notably spaced apart from one another along their entire length by a distance ε of greater than or equal to 0.2 mm.

The arms 20 form an angle γ of around 60° between one another.

The core 10 can extend along a length H substantially equal to 25 mm along the longitudinal axis X.

The applicator member 8 does not have an axis of symmetry but is nevertheless symmetrical with respect to a median plane M containing the longitudinal axis X.

The arms 20 are not in contact with the core 10 along their entire length, and have a length L greater than the distance P between their ends, the distance P being substantially equal to 23 mm.

In cross section, the core 10 has an oblong shape substantially along its entire length H, being elongate along a major axis contained in the median plane M.

The height b of the core 10, which in this case is the dimension on the median plane M, can decrease along the longitudinal axis X in the direction of its distal end 12. At its distal end, the core 10 can have a substantially circular section.

The thickness c of the core 10, measured perpendicularly to the median plane M, can also decrease along the entire length H of the core 10.

As illustrated in FIGS. 5 and 6, the ratio $K_2/K_1$ can be substantially equal to 0.7, $K_1$ being the greatest distance of the surface of the core 10 from the longitudinal axis X in the median plane M and $K_2$ being the smallest distance from one and the same abscissa on the longitudinal axis X in the same plane M.

The arms 20 preferably extend from a top side 18 of the core 10, said top side 18 being such that the surface of the core 10 is closer to the longitudinal axis X than to the opposite side 19.

The core 10 can carry a row of application elements 40 disposed between the two arms 20, at an equal distance from the latter.

These application elements 40 carried by the core 10 can be spikes with a conical shape, notably in the form of a cone of revolution. The spikes in the rows are, in the example illustrated, all aligned longitudinally and all spaced apart by the same distance o of substantially equal to 0.7 mm.

The application elements 40 can extend longitudinally in the median plane M.

As illustrated, the core 10 can have two transverse grooves 16 that extend perpendicularly to the longitudinal axis X of the core 10. These grooves 16 extend around more than 75% of the circumference of the core 10, mostly on the large underside 19 of the core 10.

The arms 20 preferably have a substantially constant thickness e of between 0.8 and 1.3 mm and a substantially constant width l of between 1 and 2 mm. The arms may have a maximum height $h_{max}$, measured from the core, of between 2.5 and 4 mm. The height $h_{max}$ is greater than the thickness e of each arm.

They are preferably flexible. This is notably on account of their small thickness and height. The arms can thus deform relatively easily on passing through the wiper.

Each arm 20 has a proximal portion 22 connected to the core 10 on the proximal side of the latter and a distal portion 24 connected to the core 10 on the distal side of the latter. The proximal portion 22 and the distal portion 24 form an elbow 26 with an angle α substantially equal to 110° between one another.

The elbow 26 is closer to the proximal end 14 of the core 10 than to the distal end 12 of the latter. Along the longitudinal axis X, the elbow 26 is at a distance f from the proximal end 14 of the core 10 of around 10% of the length H.

The proximal portion 22 is substantially rectilinear and extends, in projection along the longitudinal axis X, along a distance g of around 10% of the distance P. It is attached to the core 10, forming an angle β of around 50° with the latter.

The distal portion 24 is substantially convex towards the longitudinal axis X.

The distal portion 24 can have a first part 24*a* in contact with the core 10 and a second part 24*b* not in contact with the core 10. The first part 24*a* has a length d along the longitudinal axis X for example of around 40% of the distance P.

The second part 24*b*, the proximal portion 22 and the surface of the core 10 define between one another a free space 30 in which a reserve of cosmetic product can accumulate.

The distal portion 24 carries a longitudinal row of application elements made up of an alternation of spikes 32 and teeth 34.

Most of the spikes 32 and teeth 34 extend in a direction substantially perpendicular to the surface of the distal portion 24 to which they are attached. The spikes 32 and the teeth 34 are substantially all the same height s, being between 1.5 and 2 mm.

They are all aligned and disposed at an equal distance from one another, notably spaced apart by a distance u substantially equal to 0.7 mm.

The spikes 32 can have an axisymmetrical shape, notably a conical shape.

The teeth 34 can have an elongate cross section perpendicularly to the flat of the corresponding arm 20. The greatest width m of the teeth 34 can be greater than the width l of the arm 20 which carries them. As illustrated, the base 36 of the teeth can be wider than the width l and the teeth 34 can extend as far as the edges of the latter.

Preferably, the proximal portion 22 does not carry application elements.

The arms 20 and their application elements 32 and 34 extend around the core over a portion 41 with an angular extent λ of around 100°, in a symmetrical manner with respect to the median axis. The portion 41 is preferably on the top side 18 of the core 10.

It is possible for the remaining portion 42 of the core, having an angular extent δ of around 260°, not to have arms 20 and application elements 32 and/or 34.

The applicator member 8 does not have a plane or axis of symmetry orthogonal to the longitudinal axis X.

The applicator member 8 is preferably in one piece and moulded in a single piece.

In a variant, the applicator member is obtained by a two-shot injection moulding process.

Preferably, the applicator member 8 is made of a thermoplastic material, notably Hytrel®, SEBS, PP or PE.

Figure 7:
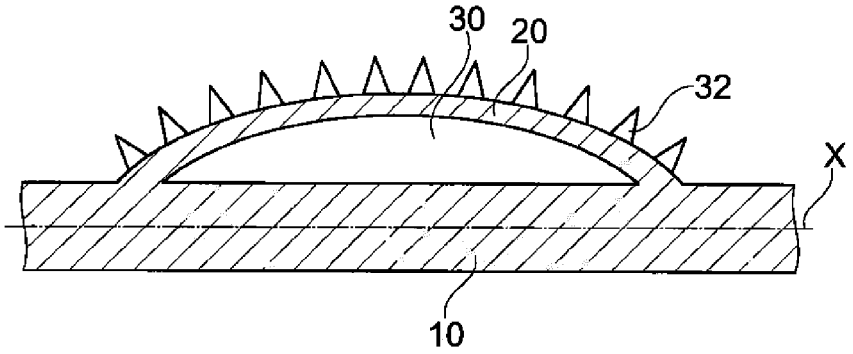
Figure 8:
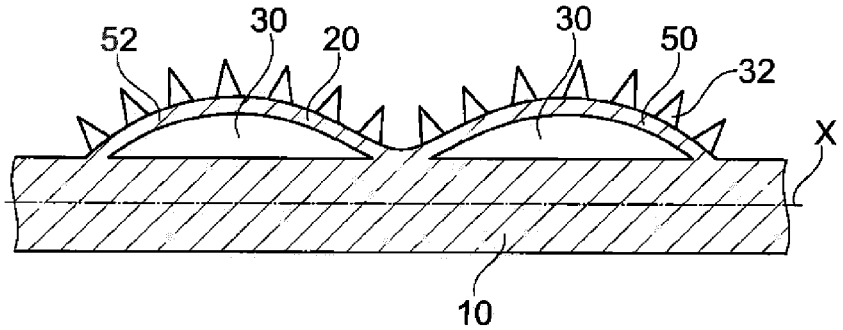
Figure 9:
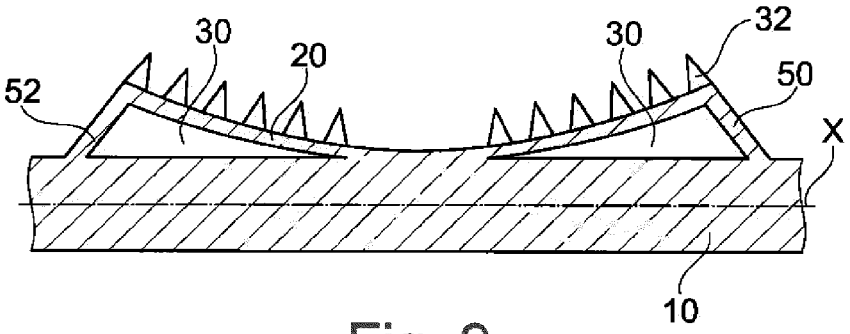

The examples illustrated in FIGS. 7 to 9 differ from the one in FIGS. 1 to 6 by way of the shape of at least one of the arms 20.

In the example illustrated in FIG. 7, the arm 20 shown has the shape of an arc of a circle.

In the examples illustrated in FIGS. 8 and 9, the arm 20 shown has two portions 50 and 52. Each of the portions 50 and 52 is connected to the core by its two ends such that the arm 20 defines two free spaces 30.

The portions 50 and 52 can each be in the form of an arch, as illustrated in FIG. 8, or can each have the same shape as an above-described arm 20, as illustrated in FIG. 9.

The applicator 2 as described above makes it possible to have, on account of the elongate shape of the core 10 in cross section and the distribution of the arms 20, vigorous wiping both of the arms 20 and of the portion away from the latter.

The distal portion 24 of each arm 20 is designed to match the curvature of the eyelid, such that a large number of eyelashes can be made up in a single hand movement.

The distal end of the applicator 2 can allow the eyelashes on the inside of the eye to be made up precisely.

The spikes 32 and teeth 34 make it possible to have good separation of the eyelashes. The alternation of said spikes 32 and teeth 34 on the arms 20 makes it possible to have both good loading and good separation of the eyelashes.

On leaving the wiper 6, the spaces 30 are filled up with product and constitute a reserve. Thus, the applicator 2 can be used without it being necessary, on each application, to dip it back into the reservoir 3.

The invention is not limited to the embodiment described above. For example, the core, the arms and/or the application elements can have other shapes, and/or the applicator member can have more than two arms.

The expression "having a" should be understood as being synonymous with "comprising at least one", and "between" is understood as including the limits, unless specified to the contrary.

The invention claimed is:

1. Applicator for applying a cosmetic product to the eyelashes and/or eyebrows, having an applicator member the applicator member having:

a core that extends along a longitudinal axis, and a plurality of different arms that are oriented longitudinally, the arms being connected to the core by their two ends, the length of each arm being greater than the distance (P) along the longitudinal axis of the core between the two ends of the arm, the core having at least one portion, between the ends of the arms, with a non-circular cross section, and the arms being distributed irregularly around the core, the at least one portion, between the ends of the arms, with a non-circular cross section, being elongate along a major axis contained in a longitudinal median plane, and having a ratio $K_2/K_1$ being between 0.5 and 0.9, $K_1$ being the greatest distance of the surface of the core from the longitudinal axis in the median plane and $K_2$ being the smallest distance from one and the same abscissa on the longitudinal axis in the median plane.

2. Applicator according to claim 1, wherein the applicator member is symmetrical with respect to a longitudinal median plane.

3. Applicator according to claim 1, wherein the core has an elongate cross section substantially along its entire length.

4. Applicator according claim 1, wherein the applicator member has, in cross section, an arm-free portion that has an angular extent δ of greater than or equal to 90° about the longitudinal axis of the core.

5. Applicator according to claim 4, the angular extent being greater than or equal to 120°.

6. Applicator according to claim 5, the angular extent being, greater than or equal to 180°.

7. Applicator according to claim 1, wherein the core has at least one transverse groove.

8. Applicator according to claim 7, the core having at least two transverse grooves extending perpendicularly to the longitudinal axis of the core.

9. Applicator according to claim 7, the one or more transverse grooves extending around more than 50% of the circumference of the core.

10. Applicator according to claim 7, the one or more transverse grooves extending around more than 75% of the circumference of the core.

11. Applicator according to claim 1, wherein the applicator member has only two arms.

12. Applicator according to claim 1, wherein the arms are not in contact with one another.

13. Applicator according to claim 1, wherein the arms form an angle γ of less than or equal to 180°, between one another.

14. Applicator according to claim 13, wherein the arms form an angle γ between 45° and 100°.

15. Applicator according to claim 13, wherein the arms form an angle γ between 50° and 70°.

16. Applicator according to claim 1, wherein each arm has a proximal portion and a distal portion that form an elbow with an angle α of between 40° and 145°.

17. Applicator according to claim 1, wherein each arm has a proximal portion and a distal portion that form an elbow with an angle α of between 100° and 130°between one another.

18. Applicator according to claim 16, the distal portion being connected to the core along a length d of less than 70% of the distance P between the two ends of the arm.

19. Applicator according to claim 16, the distal portion being connected to the core along a length of d between 50% and 20% of the distance P between the two ends of the arm.

20. Applicator according to claim 1, wherein at least one of the arms has a plurality of portions that are aligned longitudinally and are each connected to the core by their two ends.

21. Applicator according to claim 1, wherein the core carries at least one row of application elements, disposed between two adjacent arms.

22. Applicator according to claim 21, the applicator elements being spikes.

23. Applicator according to claim 21, the applicator elements being at an equal distance from the adjacent arms.

24. Applicator according to claim 1, wherein at least one of the arms carries at least one longitudinal row of application elements.

25. Applicator according to claim 1, wherein each arm carries an alternation, along the longitudinal axis X, of teeth and spikes.

26. Applicator according to claim 1, wherein the ratio $K_2/K_1$ is between 0.6 and 0.8.

27. Packaging and application device comprising:

a reservoir containing a cosmetic product to be applied, an applicator according to claim 1.

28. Makeup method comprising the step of applying a cosmetic product, with the aid of the applicator according to claim 1.

* * * * *